US008840329B2

(12) United States Patent
Okada et al.

(10) Patent No.: US 8,840,329 B2
(45) Date of Patent: Sep. 23, 2014

(54) CONVEYANCE DEVICE, PRINTING DEVICE, AND CONVEYANCE METHOD

(75) Inventors: Hiroyoshi Okada, Nagano-ken (JP); Hiroyuki Kato, Nagano-ken (JP); Norio Horaguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 13/530,159

(22) Filed: Jun. 22, 2012

(65) Prior Publication Data

US 2013/0028647 A1 Jan. 31, 2013

(30) Foreign Application Priority Data

Jul. 28, 2011 (JP) ..... 2011-165236

(51) Int. Cl.
*B41J 15/00* (2006.01)
*B65H 23/06* (2006.01)
*B65H 23/182* (2006.01)

(52) U.S. Cl.
CPC ..... *B65H 23/06* (2013.01); *B65H 2403/725* (2013.01); *B65H 2513/21* (2013.01); *B65H 2513/22* (2013.01); *B65H 23/182* (2013.01)
USPC ..... 400/618; 400/614

(58) Field of Classification Search
CPC ..... B41J 15/00; B65H 23/06; B65H 23/182
USPC ..... 400/614, 618
See application file for complete search history.

(56) References Cited

U.S. PATENT DOCUMENTS

| | | | | |
|---|---|---|---|---|
| 1,576,293 | A * | 3/1926 | Aitchison | 101/156 |
| 5,735,474 | A * | 4/1998 | Narukami | 242/332.2 |
| 6,293,192 | B1 * | 9/2001 | Bartlett | 101/212 |
| 6,435,446 | B1 * | 8/2002 | Matsuzawa | 242/422.4 |
| 2005/0129437 | A1 | 6/2005 | Ishikawa | |
| 2011/0135372 | A1 * | 6/2011 | Sato et al. | 400/614 |

FOREIGN PATENT DOCUMENTS

| | | | |
|---|---|---|---|
| JP | 2000-327181 | | 11/2000 |
| JP | 2000327181 | A * | 11/2000 |
| JP | 2001-125209 | | 5/2001 |
| JP | 2001-348147 | | 12/2001 |
| TW | 200528279 | | 9/2005 |

* cited by examiner

*Primary Examiner* — Nguyen Ha

(57) ABSTRACT

A conveyance device including a drive roller that feeds a sheet medium from a media roll having the sheet medium wound in a roll that can rotate on a center axis of the roll, a drive roller that supplies the sheet medium from the media roll, a roll rotating unit that rotates the media roll and rewinds the supplied sheet medium, and first and second brake devices that apply a load to rotation of the media roll and are disposed to the roll rotating unit, wherein the first brake device is controlled to apply the load when not energized.

8 Claims, 4 Drawing Sheets

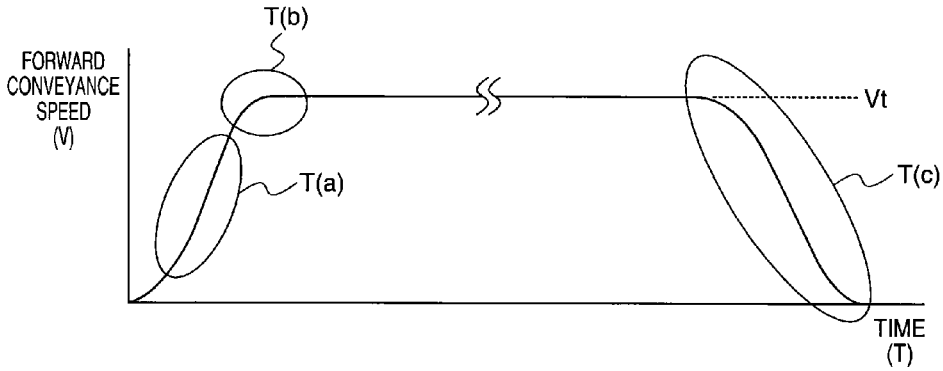
FIG. 4A
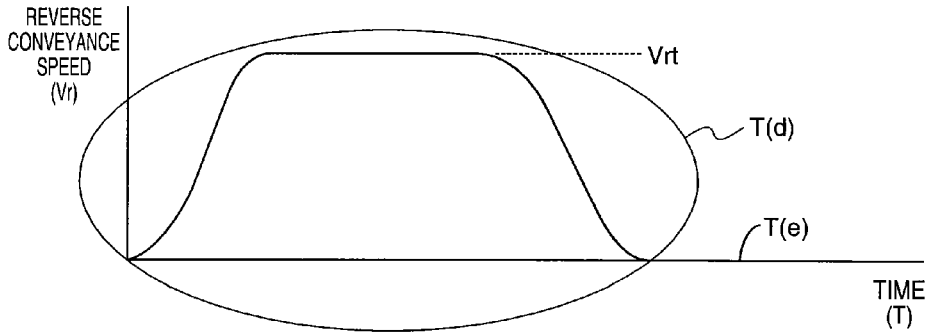
FIG. 4B
| | T(a) (ACCELERATION) | T(b) (TO CONSTANT SPEED) | T(c) (DECELERATION) | T(d) (REVERSE) | T(e) (POWER OFF) |
|---|---|---|---|---|---|
| BRAKE (1) | OFF | ON | OFF(ON) | OFF | ON |
| BRAKE (2) | OFF | OFF | ON | OFF | OFF |
| BRAKE (3) | OFF | OFF | OFF | ON | OFF |
FIG. 4C

CONVEYANCE DEVICE, PRINTING DEVICE, AND CONVEYANCE METHOD

BACKGROUND

1. Technical Field

The present invention relates to a conveyance device for sheet media stored in a roll, and relates more particularly to a conveyance device that efficiently and desirably brakes a drive gear and conveys the medium accurately with little trouble.

2. Related Art

Receipt printers and other devices that process sheet media (such as paper) stored in a roll have a device for conveying the media to a processing position. The conveyance device usually has an upstream roller that feeds the media from the roll to the conveyance path, and a downstream roller that supplies the fed media to the processing position, and the media is conveyed by driving these rollers. This conveyance device also commonly performs a reversing operation that rotates the medium stored in a roll, and rewinds the conveyed medium to a specific position.

When the conveyance operation ends (stops) and when roll media is manually loaded, inertia can cause the roll medium to rotate too much. This excess rotation can result in unnecessary slack in the medium or the roll medium becoming loose, and as a result can result in a sudden load being applied to the medium when the conveyance operation starts and interfere with accurate media conveyance.

A load is therefore commonly applied to rotation of the roll medium so that the roll does not turn too much.

To address this problem, Japanese Unexamined Patent Appl. Pub. JP-A-2000-327181 describes a roll sheet conveyance device having a spool capable of rotating a sheet roll and a sheet conveyance means that drives sheet conveyance, applies a rotational load to the spool when driving the sheet conveyance means and feeding the sheet from the spool, and prevents the rotational load from acting on the spool when driving the spool to rewind the sheet to the spool.

A device that applies a load as described above, and more specifically a braking device that stops rotation of the roll medium, generally has one brake and is configured to constantly apply a load, or uses an electromagnetic brake. Constantly applying a load means that the conveyance force must be that much greater, which is inefficient in terms of power consumption and requires a larger drive device. When an electromagnetic brake is used, the brake is not applied when the device is turned off, and unwanted rotation of the roll cannot be prevented when the roll medium is loaded by hand, for example.

Variously adjusting brake operation for forward conveyance, reverse conveyance, and at different speeds during the conveyance operation is also not possible when using a single brake as described in JP-A-2000-327181, and controlling brake operation appropriately to different conditions is difficult.

SUMMARY

A conveyance device according to the present invention is a device for conveying sheet media stored in a roll that enables efficiently and appropriately braking a drive gear to convey the sheet medium accurately with little trouble.

One aspect of the invention is a conveyance device including: a drive roller that feeds a sheet medium from a media roll having the sheet medium wound in a roll that can rotate on a center axis of the roll; a drive roller that supplies the sheet medium from the media roll; a roll rotating unit that rotates the media roll and rewinds the supplied sheet medium; and first and second brake devices that apply a load to rotation of the media roll and are disposed to the roll rotating unit; wherein the first brake device is controlled to apply the load when not energized.

A conveyance device according to another aspect of the invention preferably also has a third brake device that is disposed to the drive roller and applies a load to rotation of the drive roller.

Further preferably in a conveyance device according to another aspect of the invention, the third brake device does not apply the load when supplying the sheet medium, and the first and second brake devices do not apply the load when rewinding the sheet medium; the first and second brake devices do not apply the load during acceleration of the conveyance speed when supplying the sheet medium; the first brake device applies the load and the second brake device does not apply the load at a specific time in the transition from acceleration of the conveyance speed to a constant speed when supplying the sheet medium; and at least the second brake device applies the load during deceleration of the conveyance speed when supplying the sheet medium.

In a conveyance device according to another aspect of the invention, the load applied by the second brake device is preferably greater than the load applied by the first brake device.

Further preferably in a conveyance device according to another aspect of the invention, the third brake device is controlled to apply the load only to the direction of rotation when rewinding the sheet medium.

Another aspect of the invention is a printing device that comprises the conveyance device described above, and prints to the supplied sheet medium.

Another aspect of the invention is a conveyance method for a conveyance device that has a drive roller that feeds a sheet medium from a media roll having the sheet medium wound in a roll that can rotate on a center axis of the roll, a drive roller that supplies the sheet medium from the media roll, a roll rotating unit that rotates the media roll and rewinds the supplied sheet medium, and first and second brake devices that apply a load to rotation of the media roll and are disposed to the roll rotating unit, including a step of controlling the first brake device to apply the load when not energized.

Further preferably in the conveyance method of a conveyance device described above, the conveyance device has a third brake device that is disposed to the drive roller and applies a load to rotation of the drive roller, and the conveyance method further includes steps of: controlling the third brake device to not apply the load when supplying the sheet medium, and the first and second brake devices to not apply the load when rewinding the sheet medium; controlling the first and second brake devices to not apply the load during acceleration of the conveyance speed when supplying the sheet medium; controlling the first brake device to apply the load and the second brake device to not apply the load at a specific time in the transition from acceleration of the conveyance speed to a constant speed when supplying the sheet medium; and controlling at least the second brake device to apply the load during deceleration of the conveyance speed when supplying the sheet medium.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 describes different phases in speed control and the state of each brake.

DESCRIPTION OF EMBODIMENTS

Figure 1:
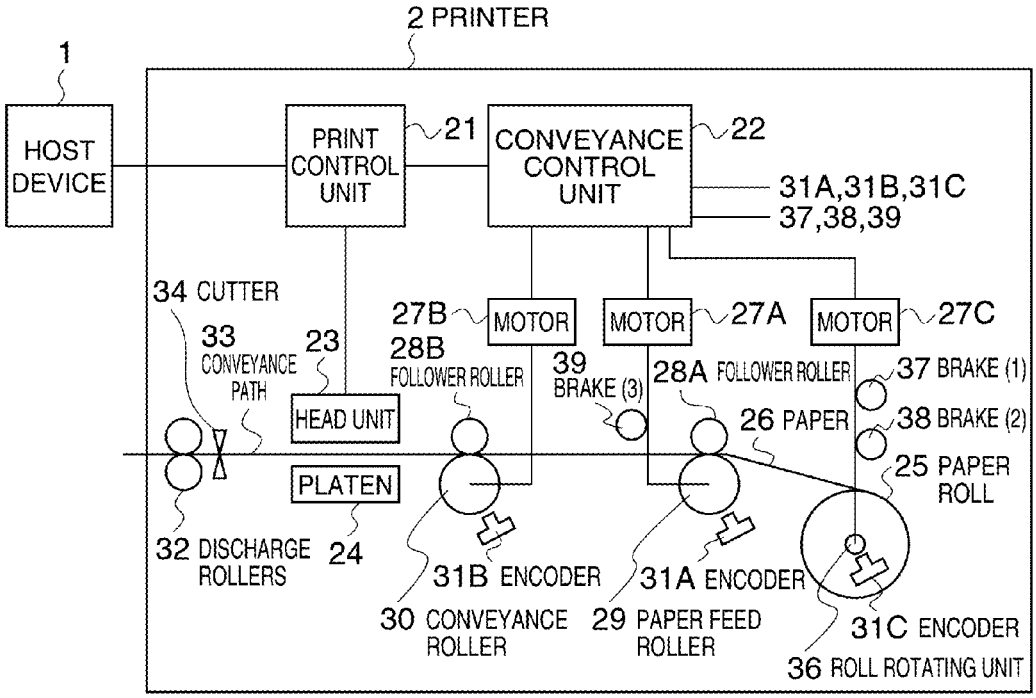
FIG. 1 is a block diagram of a preferred embodiment of a printing device having a conveyance device according to the invention.

A preferred embodiment of the invention is described below with reference to the accompanying figures. The following embodiment does not, however, limit the technological scope of the invention. Note that identical or similar parts are notified in the figures by the same reference numerals or reference symbols.

FIG. 1 is a block diagram of a preferred embodiment of a printing device having a conveyance device according to the invention. The printer 2 shown in FIG. 1 is a printing device according to this embodiment of the invention, and has a conveyance device that conveys paper 26 stored in a roll to the printing position using a paper feed roller 29 (upstream roller, drive roller) and conveyance roller 30 (downstream roller), and when rewinding the conveyed paper 26 reverses the paper 26 by driving a roll rotating unit 36. This conveyance device also has three types of brakes (sliding load devices), brake (1) 37, brake (2) 38, and brake (3) 39, disposed to the drive gear train of the paper feed roller 29 and roll rotating unit 36. By desirably operating these brakes, the printing device can apply the appropriate brake at the necessary time to efficiently and accurately convey the paper 26.

As shown in FIG. 1, the printer 2 is a device that receives commands from a computer or other host device 1 and performs a printing process, and in this embodiment is a printing device that uses roll paper 25 (roll medium) as the paper 26 (sheet medium) and prints continuously while conveying the paper 26.

FIG. 1 is a block diagram showing the configuration of the printer 2. The printer 2 has a printing system that controls the print content and performs a printing process on the paper 26, and a conveyance system that handles conveying the paper 26.

A print control unit 21 is disposed to the printing system. The print control unit 21 receives print commands from the host device 1, and outputs print commands to the head unit 23 and paper 26 conveyance commands to the conveyance control unit 22 of the conveyance mechanism based on the received commands. The head unit 23 prints on the paper 26 moving at a specific speed between the head unit 23 and platen 24 according to the print commands.

As shown in FIG. 1, the conveyance system continuously conveys the paper 26 stored in a paper roll 25 in a print medium storage (holding) location forward (downstream) through a conveyance path 33, cuts the printed portion with a cutter 34, and discharges the cut portion from the printer 2 through discharge rollers 32. The conveyance system also executes a reverse conveyance operation after the forward conveyance operation to convey the leading end of the paper 26 in the reverse direction (upstream) to a specific position (indexed position) on the upstream side of the head unit 23.

The conveyance system includes a paper feed roller 29 (upstream roller) and conveyance roller 30 (downstream roller) that are driven by corresponding motors (27A, 27B). Disposed opposite each of these rollers with the paper 26 therebetween is a follower roller (28A, 28B). Each follower roller can move perpendicularly to the surface of the paper 26, and can be set to two vertical positions. At the down position in contact with the paper 26, the follower rollers are urged with a downward vertical force to the surface of the paper 26, pressing the paper 26 with a force perpendicular to the paper 26 surface and holding the paper 26 with the opposing roller (29, 30). This state is called the nipped state. At the up position separated from the paper 26, the force holding the paper 26 is not applied. This is called the released state.

A function of the paper feed roller 29 is to supply the paper 26 from the paper roll 25 to the conveyance path 33. The paper feed roller 29 is driven by torque from the motor 27A transferred thereto through a speed reducer (drive gear train), and moves the paper 26 by the force of friction against the paper 26 pressed between the paper feed roller 29 and follower roller 28A. These rollers are also used when reversing the paper 26.

A function of the conveyance roller 30 is to convey the paper 26 supplied by the paper feed roller 29 to the printing position, or more specifically to the head unit 23 position. The conveyance roller 30 is turned by torque transferred thereto from the motor 27B through a speed reducer, and moves the paper 26 by the force of friction against the paper 26 held between the conveyance roller 30 and follower roller 28B.

An encoder 31A, 31B is respectively disposed to the paper feed roller 29 and conveyance roller 30, and rotation of the rollers detected by the corresponding encoders is reported to the conveyance control unit 22.

The conveyance system also includes the roll rotating unit 36. The roll rotating unit 36 rotates the paper 26 stored in a paper roll 25, and rewinds the paper 26 that was fed. The roll rotating unit 36 is driven by motor 27C, and includes a speed reducer (drive wheel train 362) that transfers torque from the motor 27C, and a roll spindle 361 that passes through the center of the paper roll 25 and is rotated by the torque transferred thereto through the speed reducer.

An encoder 31C is also disposed to the roll rotating unit 36, and detects and reports rotation of the paper roll 25 to the conveyance control unit 22.

As described above, the conveyance system has three types of brakes, brake (1) 37, brake (2) 38, and brake (3) 39. Of these, brake (1) 37 and brake (2) 38 are disposed to the drive gear train of the roll rotating unit 36.

Figure 2:
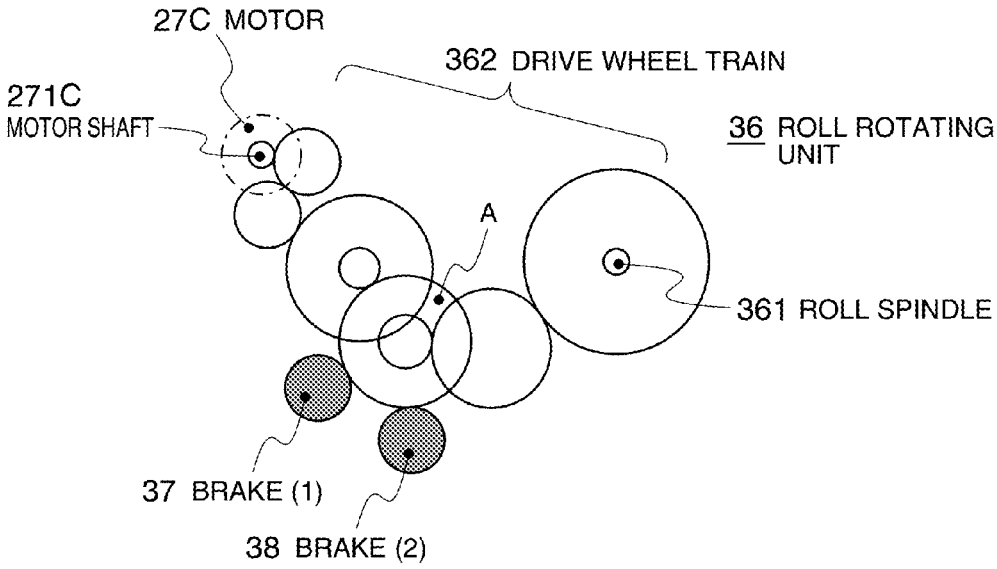
FIG. 2 describes the positioning of brake (1) 37 and brake (2) 38.

FIG. 2 shows the placement of the brake (1) 37 and brake (2) 38. FIG. 2 schematically shows the configuration of the roll rotating unit 36 including the motor 27C. As shown in the figure, the motor shaft 271 and roll spindle 361 are connected by a drive wheel train 362 composed of plural drive gears, and rotation of the motor shaft 271C is reduced to a specific speed and transferred to the roll spindle 361.

In this example brake (1) 37 and brake (2) 38 are disposed to drive gear A, and force for stopping rotation of drive gear A is applied when brake (1) 37 and brake (2) 38 are operated to apply brake force (sliding load). More specifically, the brakes apply force to stop rotation of the paper roll 25 mounted on the outside of the roll spindle 361.

A device that electrically controls (turns on/off) whether or not brake force is applied and applies brake force mechanically is used for brake (1) 37. Various configurations known from the literature can be used, including a device having a disc that contacts the drive gear A from the axial direction and is fastened so that it cannot rotate with the drive gear A, and a coil spring that suppresses rotation disposed coaxially to the drive gear A, and controls the on/off state of the brake by moving the disc axially to contact or not contact the drive gear A. As a result, once the conveyance control unit 22 turns the brake on, brake force can be applied even when not energized. Note that brake (1) 37 can apply brake force regardless of the direction of rotation.

Brake (2) 38 is a device that applies greater brake force than brake (1) 37, and is also controlled on/off by the conveyance control unit 22. Specific examples of suitable devices include electromagnetic brakes, electromagnetic clutches, and other devices known from the literature. This brake (2) 38 must also be able to apply brake force at least to the direction of rotation when conveying the paper 26 forward (downstream).

Brake (3) 39 applies force to brake rotation of the paper feed roller 29 described above, and is disposed to the drive gear train connecting the motor 27A and paper feed roller 29. The location of brake (2) 38 is not shown in the figure, but like brake (1) 37 and brake (2) 38 in FIG. 2 is disposed to apply a sliding load to a drive gear in the drive gear train. A device that can apply brake force only to the direction of rotation when the paper 26 is conveyed in reverse (upstream) is used for brake (3) 39. An example of a specific construction is a one-way clutch or other device known from the literature, and could constantly apply brake force (be on), or could be controlled on/off by the conveyance control unit 22.

Next, the conveyance control unit 22 shown in FIG. 1 is the part that controls the conveyance system, and based on instructions from the print control unit 21 controls the above paper 26 conveyance operation. More specifically, the conveyance control unit 22 controls driving and stopping the paper feed roller 29, conveyance roller 30, and roll rotating unit 36 to desirably convey the paper 26 forward and reverse. The conveyance control unit 22 also controls the on/off state of the brakes 37 to 39 as described above. This braking control is a unique feature of this printer 2, and is described specifically below.

While not shown in the figures, the conveyance control unit 22 includes a CPU, ROM, RAM, and NVRAM (nonvolatile memory), and the foregoing process executed by the conveyance control unit 22 is executed by the CPU operating according to a program stored primarily in ROM.

Data required for processing is temporarily stored in RAM, which also stores output from the encoders 31 that is required for controlling driving and stopping the paper feed roller 29, conveyance roller 30, and roll rotating unit 36.

The conveyance system including the paper feed roller 29, conveyance roller 30, roll rotating unit 36, brakes 37 to 39, and conveyance control unit 22 is an example of a conveyance device according to the invention.

The printer 2 configured as described above is characterized by controlling braking using the brakes 37 to 39 as described in detail below.

As described above, the printer 2 conveys the paper 26 forward when printing and rewinds the paper 26 in reverse after printing ends, and the brakes are applied differently in these operations. Braking during forward conveyance is described first.

Figure 3:
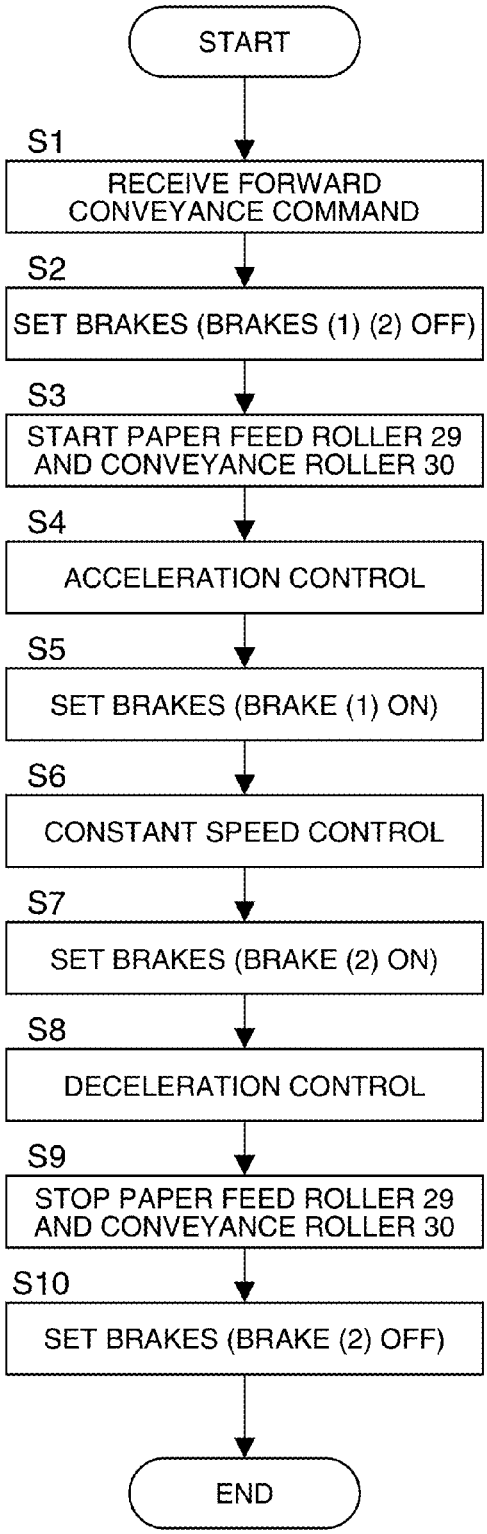
FIG. 3 is a flow chart showing steps in the control process executed by a conveyance control unit 22 during forward conveyance.

FIG. 3 is a flow chart of the control process of the conveyance control unit 22 during forward conveyance.

When a forward rotation (forward conveyance) command is received from the print control unit 21 (step S1), the conveyance control unit 22 applies control to turn the brakes 37 to 39 on/off appropriately (step S2). Because the conveyance speed is 0 at this time and operation starts with acceleration, all brakes 37 to 39 are turned off, that is, set so that brake force is not applied. If the brakes are already off, they remain off. Note that because brake force is not applied by brake (3) 39 during forward conveyance, it can be considered to be always off during conveyance in this direction.

The conveyance control unit 22 then starts the paper feed roller 29 and conveyance roller 30 in the nipped position, and starts conveying the paper 26 (step S3). Because the printer 2 conveys the paper 26 at a specific predetermined speed (target speed Vt), the conveyance control unit 22 accelerates conveyance until the target speed Vt is reached (step S4). Note that conveyance speed control in the printer 2 is done by PID control based on the output of the encoders 31 according to a predetermined speed curve.

FIG. 4 shows the phases of speed control and the on/off states of the brakes. FIG. 4A is a graph showing the change over time in the conveyance speed during forward conveyance. Acceleration control is applied during phase T(a) in the graph, that is, the period during acceleration to the target speed Vt.

FIG. 4C shows the states of the brakes 37 to 39 in each phase of speed control. As described above, because all brakes 37 to 39 are off during acceleration control, brake force is not applied by any of the brakes 37 to 39 during acceleration, there is no loss of drive power, and the conveyance speed can be efficiently increased.

At a specific time when the conveyance speed reaches the target speed Vt, the conveyance control unit 22 turns brake (1) 37 on (step S5). The other brakes (2) 38 and (3) 39 remain off. This specific time is predetermined and can be set to when a specific speed close to the target speed Vt is reached, when the target speed Vt is reached, or when the paper has been conveyed a specific distance after conveyance starts, for example.

When the conveyance speed almost reaches the target speed Vt, the conveyance control unit 22 applies constant speed control (step S6). This mode corresponds to phase T(b) in FIG. 4, and the brakes go from the acceleration mode to the constant speed mode shown in FIG. 4C. More specifically, only brake (1) 37 is on and acceleration slows to 0.

During the phase when acceleration decreases, the paper roll 25 can rotate greater than the speed of the paper 26 due to inertia and produce slack in the paper 26, but this is suppressed by the braking force of the brake (1) 37.

When constant speed control ends, that is, when the printing process ends and forward conveyance starts to stop, the conveyance control unit 22 turns brake (2) 38 on at a specific time when the conveyance speed starts to drop from the target speed Vt (step S7). Brake (3) 39 remains off and brake (1) 37 turns off, at this time, but brake (1) 37 could be kept on depending upon the brake force of brake (1) 37 and brake (2) 38. This specific time is predetermined and could be when the speed starts to drop from the target speed Vt, or timed to conveyance a specific distance after conveyance starts starts, for example.

The conveyance control unit 22 then applies deceleration control to stop conveyance (step S8). Deceleration occurs during phase T(c) in FIG. 4, and because brake (2) 38 or both brake (1) 37 and brake (2) 38 work to brake the roll rotating unit 36 as shown in FIG. 4C, the paper roll 25 is desirably prevented from turning too much due to the inertia of the paper roll 25 when decelerating and stopping. Because the inertia of the paper roll 25 is greater when decelerating and stopping than when going from acceleration to a constant speed, the brakes are controlled to apply greater brake force.

The conveyance control unit 22 then stops driving the paper feed roller 29 and conveyance roller 30 (step S9), ends the commanded conveyance operation, and turns brake (2) 38 off (step S10). Note that the brake (1) 37 is off if it is known that a conveyance operation will be performed next, and is otherwise on.

Figure 5:
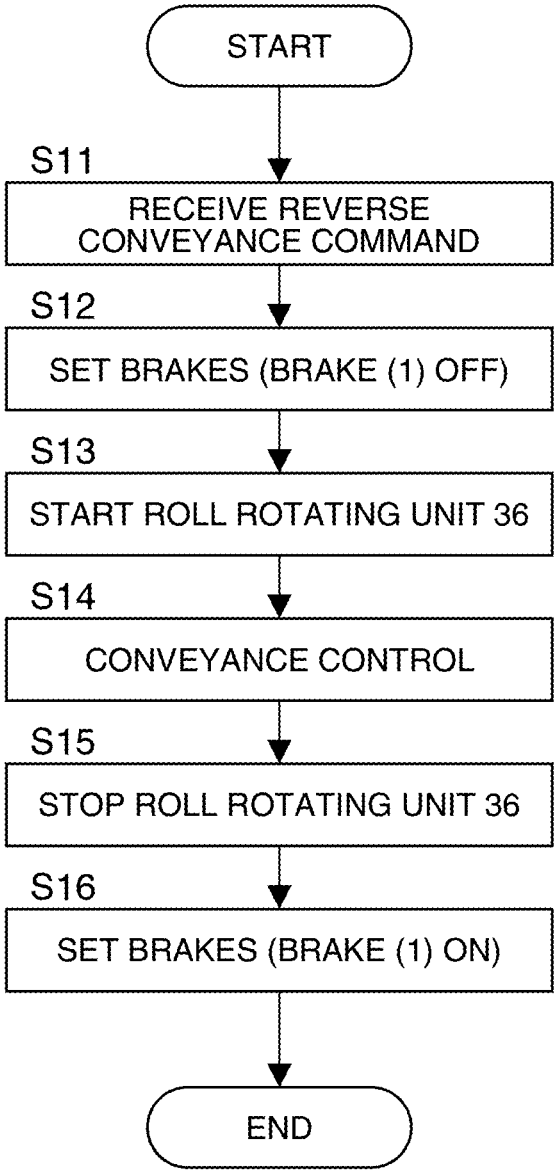
FIG. 5 is a flow chart showing steps in the process executed by a conveyance control unit 22 during reverse conveyance.

Control in the reverse direction is described next. FIG. 5 is a flow chart of the control steps of the conveyance control unit 22 during reverse conveyance.

When a reverse rotation (reverse conveyance) command is received (step S11), the conveyance control unit 22 controls the brakes 37 to 39 to the desired on/off states (step S12). More specifically, brake (1) 37 and brake (2) 38 are off and brake (3) 39 is on.

The conveyance control unit 22 then starts driving the roll rotating unit 36 with the paper feed roller 29 in the nipped position (step S13), controls conveyance at a specific speed (step S14), and stops driving the roll rotating unit 36 after the desired conveyance distance is reached (step S15). As during forward conveyance, PID control is used as the control method.

FIG. 4B is a graph showing the change in the conveyance speed over time during reverse conveyance. Conveyance control in this case includes acceleration to the target speed Vrt, constant speed control at the target speed, and deceleration to a stop. Because the brake force of brake (3) 39 is applied to the paper feed roller 29 during this conveyance control, that is, phase T(d), as shown in FIG. 4C, the paper feed roller 29 is prevented from rotating too much due to inertia when the paper roll 25 slows and stops, and creating slack in the paper 26 can be prevented.

When the commanded reverse conveyance operation then ends, the conveyance control unit 22 turns brake (1) 37 on (step S16). Note that the brake (1) 37 is off if it is known that a conveyance operation will be performed next.

If the printer 2 power may turn off, the conveyance control unit 22 always turns the brake (1) 37 on. More specifically, the brake force of brake (1) 37 is normally applied when the printer 2 is not energized, such as when paper roll 25 is manually loaded. As a result, slack in the paper 26 and loosely winding the paper roll 25 as a result of the paper roll 25 turning too much can be suppressed. Note that brake (2) 38 and brake (3) 39 are both off at this time as shown in FIG. 4C.

As described above, because the printer 2 according to this embodiment of the invention has two brakes that can be separately turned on and off disposed to the roll rotating unit 36, whether brake force is applied and the amount of brake force applied can be controlled, and braking can be desirably controlled according to the situation. More specifically, as described above, braking can be desirably controlled during the transition from acceleration to constant speed conveyance, and from deceleration to a stop. As a result, creating unnecessary slack in the paper 26 can be prevented.

Furthermore, because the brakes can be controlled so that no brake force is applied during acceleration, operation is efficient with respect to power consumption and there is no need for a motor that is larger than necessary.

Furthermore, because a brake is constantly applied when the printer 2 power is off, the paper roll 25 does not rotate unnecessarily when loading the paper roll 25 and when moving the printer 2, and paper 26 slack and loosening of the paper roll 25 can be prevented.

A brake is also disposed to the paper feed roller 29, and the paper 26 can be prevented from rewinding too much when the paper is rewound. This also prevents unnecessary slack in the paper 26, and can keep the paper correctly positioned after conveyance ends.

Furthermore, by configuring brake (3) 39 to apply brake force in one direction only, it can be always on, thereby simplifying control.

As described above, this printer 2 can apply the brakes appropriately to the situation during forward and reverse conveyance, and when the power is off.

The foregoing embodiment is described using paper as the print medium, but the invention is not so limited and any type of sheet media can be used.

The foregoing embodiment is also described with the conveyance device disposed to a printer, but conveyance devices applying the invention can be used with other devices that apply other processes to sheet media, including mechanical processes, laser processes, and fluid ejection processes.

The invention being thus described, it will be obvious that the invention can be varied in many ways. Such variations are not to be regarded as a departure from the spirit and scope of the invention, and all such modifications as would be obvious to one skilled in the art are intended to be included within the scope of the following claims.

What is claimed is:

1. A conveyance device comprising:

a drive roller that feeds a sheet medium from a media roll having the sheet medium wound in a roll that can rotate on a center axis of the roll;

a drive roller that supplies the sheet medium from the media roll;

a roll rotating unit that rotates the media roll and rewinds the supplied sheet medium;

first and second brake devices that apply a load to rotation of the media roll and are disposed to the roll rotating unit; wherein a third brake device that is disposed to the drive roller and applies a load to rotation of the drive roller;

the first brake device is controlled to apply the load when the conveyance device is not energized;

the first and second brake devices do not apply the load during acceleration of conveyance speed when supplying the sheet medium; and the first brake device applies the load and the second brake device does not apply the load at a specific time in a transition from acceleration of the conveyance speed to a constant speed when supplying the sheet medium.

2. The conveyance device described in claim 1, wherein:

the third brake device does not apply the load when supplying the sheet medium, and the first and second brake devices do not apply the load when rewinding the sheet medium; and at least the second brake device applies the load during deceleration of the conveyance speed when supplying the sheet medium.

3. The conveyance device described in claim 1, wherein:

the load applied by the second brake device is greater than the load applied by the first brake device.

4. The conveyance device described in claim 1, wherein:

the third brake device is controlled to apply the load only to the direction of rotation when rewinding the sheet medium.

5. A printing device that comprises the conveyance device described in claim 1, and prints to the supplied sheet medium.

6. A conveyance method of a conveyance device that has a drive roller that feeds a sheet medium from a media roll having the sheet medium wound in a roll that can rotate on a center axis of the roll, a drive roller that supplies the sheet medium from the media roll, a roll rotating unit that rotates the media roll and rewinds the supplied sheet medium, and first and second brake devices that apply a load to rotation of the media roll and are disposed to the roll rotating unit, comprising a step of:

controlling the first brake device to apply the load when the conveyance device is not energized;

controlling the first and second brake devices to not apply the load during acceleration of a conveyance speed when supplying the sheet medium; and controlling the first brake device to apply the load and the second brake device to not apply the load at a specific time in a transition from acceleration of the conveyance speed to a constant speed when supplying the sheet medium.

7. The conveyance method of a conveyance device described in claim 6, wherein the conveyance device has a third brake device that is disposed to the drive roller and applies a load to rotation of the drive roller, and the conveyance method further comprises steps of:

controlling the third brake device to not apply the load when supplying the sheet medium, and the first and second brake devices to not apply the load when rewinding the sheet medium; and controlling at least the second brake device to apply the load during deceleration of the conveyance speed when supplying the sheet medium.

8. The conveyance method of a conveyance device described in claim 6, further comprising a step of:

controlling a third brake device to apply the load only to the direction of rotation when rewinding the sheet medium.

* * * * *